United States Patent [19]

Gach

[11] Patent Number: 4,699,299

[45] Date of Patent: Oct. 13, 1987

[54] ADJUSTABLE DISPENSING CLOSURE

[75] Inventor: Peter P. Gach, Evansville, Ind.

[73] Assignee: Sunbeam Plastics Corporation, Evansville, Ind.

[21] Appl. No.: 655,231

[22] Filed: Sep. 28, 1984

[51] Int. Cl.[4] ..... B67D 3/00

[52] U.S. Cl. ..... 222/480; 222/482; 222/498

[58] Field of Search ..... 222/142.6, 142.7, 142.9, 222/196.2, 478, 480, 548, 565, 570, 481, 482, 498, 544

[56] References Cited

U.S. PATENT DOCUMENTS

| | | | |
|---|---|---|---|
| 1,124,523 | 1/1915 | Reeser | 222/480 |
| 2,362,387 | 11/1944 | Ludwig | 222/480 X |
| 2,655,288 | 10/1953 | Caretto | 222/548 X |
| 3,042,273 | 7/1962 | Bauer et al. | 222/548 |
| 3,214,069 | 10/1965 | Dike | 222/536 X |
| 3,388,841 | 6/1968 | McHardy et al. | 222/548 |
| 3,389,840 | 6/1968 | Musel et al. | 222/565 X |
| 4,299,339 | 11/1981 | Giroux et al. | 222/548 X |
| 4,500,016 | 2/1985 | Funfstuck | 222/153 |

*Primary Examiner*—Joseph J. Rolla
*Assistant Examiner*—Michael S. Huppert
*Attorney, Agent, or Firm*—Irvin L. Groh; Alfred L. Patmore, Jr.

[57] ABSTRACT

An adjustable dispensing closure including a body member provided with an opening and a lid member formed with a plurality of apertures of different sizes. The lid member is rotatable relative to the body member to permit regulated dispensing of the contents of the container. The lid member is held relative to the closure body by complementary annular rings for rotation through a full 360 degrees between closed and selected open positions.

4 Claims, 4 Drawing Figures

ADJUSTABLE DISPENSING CLOSURE

The present invention relates to closures for containers and particularly to dispensing closures by which the contents of a container with which the closure is used is dispensed at a controlled rate.

Dispensing closures frequently are used with containers for packaging a wide variety of products, usually liquids ranging widely in viscosity from edibles such as syrup and catsup to non-edibles such as liquid detergents and shampoos. It frequently is necessary for manufacturers who package several products having different viscosities to carry inventory of dispensing closures of different sizes to accommodate packaging of the different products. It would be highly desirable in such instances to have a single dispensing closure that could accommodate a variety of products of different viscosities by offering the possibility of varying the orifice or selecting an orifice of a particular size. Such a closure also could offer the consumer or purchaser a choice of a dispensing opening which is larger or smaller than the one recommended by the manufacturer.

The dispensing closure contemplated by the present invention includes a closure body adapted for attachment to a container and is formed with an opening of a predetermined size radially offset from the axis of the body to form a passage for the contents of the container. The opening is closed by a lid or cap member rotatably connected to the body. The lid member is provided with a plurality of apertures having the axes radially offset relative to the axis of the lid member a distance equal to the distance of the opening in the closure body with the plurality of apertures progressively diminishing in size to provide a range of openings so that rotation of the liquid member relative to the body member brings a selected one of the apertures into alignment with the opening in the body member to permit dispensing of the contents of the container.

A preferred embodiment of the invention is illustrated in the drawings in which.

Figure 1:
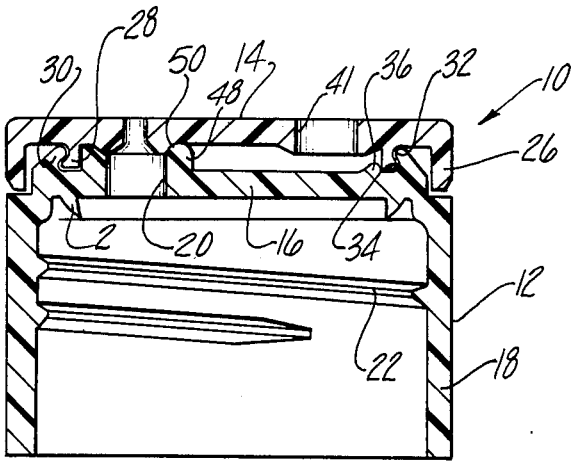
FIG. 1 is a cross-sectional view of a dispensing closure assembly embodying the invention.

The adjustable dispensing closure embodying the present invention is designated generally at 10 and includes a closure body 12 and a cap member 14. The closure body 12 and cap member 14 are generally cylindrical and have the same diameter.

The closure body 12 is generally cup-shaped with a top wall 16 and a depending cylindrical skirt 18. The top wall 16 is provided with a dispensing opening 20 through which the contents of the container with which the closure 10 is used is dispensed. The interior wall of the skirt 18 is provided with threads 22 by which the closure 10 may be attached to a container (not shown). Other forms of fastening means such a snap beads or adhesive may also be used to permanently attach the closure 10 to the container.

The underside of the top wall 16 is provided with an annular seal 2 which engages the top of the container opening to ensure that the contents of the container must pass through the opening 20.

Figure 2:
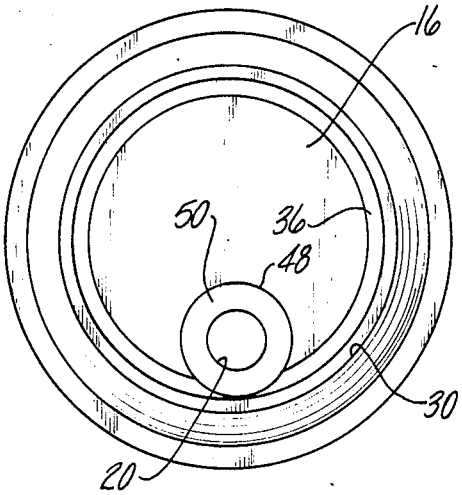
FIG. 2 is a top plan view of a closure body forming one element of a dispensing closure assembly.
Figure 4:
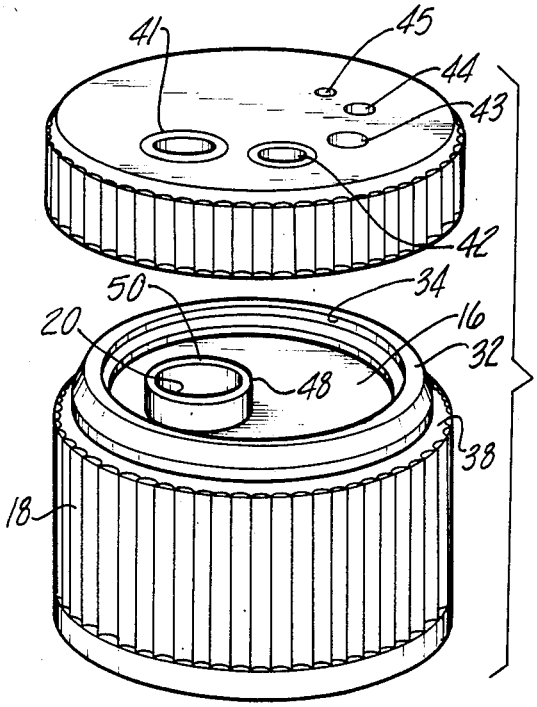
FIG. 4 is an exploded perspective view of the two parts making up the dispensing closure of the present invention.
Figure 3:
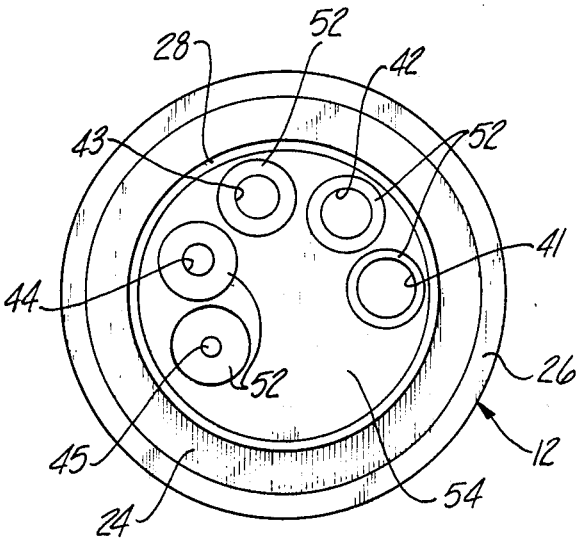
FIG. 3 is a bottom view of a lid member forming another element of the closure assembly.

The cap member 14 has a generally disc-shaped top with a depending skirt portion 26 having the same perimeter as the skirt 18 of the closure body 12. In the assembled condition of the closure body 12 and cap 14 as seen in Fig. 2, the respective skirts 18 and 26 are in alignment with each other.

The body 12 and cap 14 are held in relatively rotatable relationship to each other by an annular bead 28 formed on the underside of the cap member 14 and a complementary annular bead 30 formed on the top of the wall 16 of the closure body 12. The annular bead 28 forms a radially outwardly facing groove 32 which receives the outer lip of the annular bead 30. Similarly, the annular bead 30 forms a radially inwardly facing groove 34 which receives the outer lip of the annular bead 28. The interlocking action of the annular bead 28 and 30 serves to maintain the closure body 12 and cap 14 in axially fixed relationship to each other and at the same time permits free rotation of the cap 14 relative to the body 12 by maintianing the skirt 26 axially spaced a slight amount from a shoulder 38 formed at the upper end of the skirt 18 and by maintaining a slight radial spacing between the inner surface of the skirt 26 and the annular bead 30 of closure body 12. Retention of the beads 28 and 30 in interlocking relationship with each other is further facilitated by an annular guide bead 36 seen in FIGS. 1 and 2 and formed on the top of the wall 16.

The cap member 14 is provided with a plurality of apertures 41, 42, 43, 44 and 45. The largest of the apertures 41 corresponds generally in size to the opening 20 in the closure body 12 and the remaining openings progressively decrease in size to opening 45 which is the smallest of the openings. The opening 20 in the top wall 16 is surrounded by a collar 48 which has an annular seating surface 50 surrounding the opening. The seating surface 50 is complementary to a raised seating surface 52 which surrounds each of the openings.

The opening 20 is offset a predetermined radial distance from the axis of the closure body 12 and similarly, the apertures 41 through 45 are disposed on an arc having a radius equal to the same predetermined distance so that upon rotation of the cap 14, selected ones of the openings or apertures come into alignment with the opening 20. A portion of the same arc indicated generally at 54 which is disposed between the largest of the openings 41 and the smallest of the openings 45 can be brought into alignment with the opening 20 to maintain it in a closed condition preventing the dispensing of the contents of the container with which the closure 10 is used.

After a container with which the closure 10 is used has been filled with its intended contents, the closure 10 is used by rotating the cap member 14 relative to the stationary closure body 12 to bring a selected one of the apertures 41 through 45 into alignment with the opening 20 an the closure body 12. Upon selecting one of the apertures, the closure body 12 and cap 14 are held in the selected relationship by the coaction of the seating surface 52 surrounding the selected opening and the seat 50 in the collar 48.

The embodiment of the invention in which an exclusive property or privilege is claimed are defined as follows:

1. A two piece adjustable orifice dispensing closure comprising: a closure body adapted for attachment to a container and having a generally cylindrical skirt and a top wall containing an opening of a predetermined size radially offset a predetermined distance from the axis of the body, an annular sealing surface surrounding said opening and raised above said top wall, an annular bead on said closure body located radially inward from said cylindrical skirt; and a lid member rotatably connected to said body by a complementary bead engageable with said annular bead on said body, holding said body and lid member in an axially fixed relationship permitting relative rotation between said body and said lid, said lid member having an annular skirt coextensive with the cylindrical skirt of said closure body, and said annular skirt being radially spaced from said annular bead of said closure body, said lid member further having a top containing a plurality of apertures with their axes radially offset relative to the axis of said lid member a distance equal to said predetermined distance, said plurality of apertures progressively diminishing in size from a size substantially equal to the opening in said top wall to a predetermined minimum size, raised annular sealing seats surrounding each of said apertures, each seat being complementary to said sealing surface independent of said aperture size whereby rotation of said lid member relative to said body permits alignment of a selected one of said apertures with the opening in said body and one of said sealing seats will engage said sealing surface to resiliently resist rotation of said lid member relative to said closure body.

2. A two piece adjustable orifice dispensing closure comprising: a closure body adapted for attachment to a container and having a top wall containing an opening of a predetermined size radially offset a predetermined distance from the axis of the body, an annular sealing surface surrounding said opening and raised above said top wall, a lid member rotatably connected to said body, said lid member having a skirt portion defining the circumference of said lid member, said skirt portion being adjacent to but in axially and circumferentially spaced relationship to said closure body, said lid member further having a top containing a plurality of apertures with their axes radially offset relative to the axis of said lid member a distance equal to said predetermined distance, said plurality of apertures progressively diminishing in size from a size substantially equal to the opening in said body top wall to a predetermined minimum size, raised annular sealing seats surrounding each of said apertures, each seat being complementary to said sealing surface independent of said aperture size whereby rotation of said lid member relative to said body permits alignment of a selected one of said apertures with the opening in said body and one of said sealing seats will engage said sealing surface to resiliently resist rotation of said lid member relative to said closure body.

3. The dispensing closure of claim 2 wherein said apertures are circular and have their axes on an arc having a radius equal to said predetermined distance.

4. The dispensing closure of claim 3 wherein a closure portion is formed by said lid member on the remaining portion of said arc not occupied by said apertures.

* * * * *